US007174975B2

(12) United States Patent
Krueger et al.

(10) Patent No.: US 7,174,975 B2
(45) Date of Patent: Feb. 13, 2007

(54) CONTROL SYSTEMS AND METHODS FOR ACTIVE CONTROLLED BOTTOMHOLE PRESSURE SYSTEMS

(75) Inventors: Sven Krueger, Winsen/Aller (DE); Volker Krueger, Celle (DE); Harald Grimmer, Lachendorf (DE); Roger Fincher, Conroe, TX (US); Larry Watkins, Houston, TX (US); Peter Aronstam, Houston, TX (US); Peter Fontana, The Woodlands, TX (US)

(73) Assignee: Baker hughes Incorporated, Houston, TX (US)

( * ) Notice: Subject to any disclaimer, the term of this patent is extended or adjusted under 35 U.S.C. 154(b) by 327 days.

(21) Appl. No.: 10/936,858

(22) Filed: Sep. 9, 2004

(65) Prior Publication Data

US 2005/0098349 A1 May 12, 2005

Related U.S. Application Data

(63) Continuation-in-part of application No. 10/783,471, filed on Feb. 20, 2004, now Pat. No. 7,114,581, which is a continuation of application No. 10/251,138, filed on Sep. 20, 2002, now abandoned, application No. 10/936,858, which is a continuation-in-part of application No. 10/716,106, filed on Nov. 17, 2003, now Pat. No. 6,854,532, which is a continuation of application No. 10/094,208, filed on Mar. 8, 2002, now Pat. No. 6,648,081, which is a continuation of application No. 09/353,275, filed on Jul. 14, 1999, now Pat. No. 6,415,877.

(60) Provisional application No. 60/323,803, filed on Sep. 20, 2001, provisional application No. 60/108,601, filed on Nov. 16, 1998, provisional application No. 60/101,541, filed on Sep. 23, 1998, provisional application No. 60/095,188, filed on Aug. 3, 1998, provisional application No. 60/092,908, filed on Jul. 15, 1998.

(51) Int. Cl.
*E21B 7/00* (2006.01)

(52) U.S. Cl. ..... 175/57; 175/107; 175/324

(58) Field of Classification Search ..... 175/57, 175/65, 393, 339, 324, 213, 217; 166/368
See application file for complete search history.

(56) References Cited

U.S. PATENT DOCUMENTS 2,812,723 A 11/1957 Coberly (Continued)

FOREIGN PATENT DOCUMENTS

EP 0290250 9/1988

(Continued)

OTHER PUBLICATIONS

*New Tool Addresses ECD Problem*, William Furlow, Offshore, pp. 88, 89, Jun. 2002.

(Continued)

*Primary Examiner*—Frank Tsay
(74) *Attorney, Agent, or Firm*—Madan, Mossman & Sriram, P.C.

(57) ABSTRACT

Methods and control systems are provided for a wellbore drilling system having an active differential pressure device (APD device) in fluid communication with a returning fluid. The APD Device creates a differential pressure across the device, which reduces the pressure below or downhole of the device. In embodiments, a control unit controls the APD Device to provide a selected pressure differential at a wellbore bottom, adjacent a casing shoe, in an intermediate wellbore location, or in a casing. In one arrangement, the control system is pre-set at the surface such that the APD Device provides a substantially constant pressure differential. In other arrangements, the control system measures one or more parameters (e.g., wellbore pressure, formation parameters, BHA parameters, etc.) and adjusts an operating parameter of the APD Device to provide a desired pressure differential. Devices such as an adjustable bypass can be used to control the APD Device.

23 Claims, 11 Drawing Sheets

U.S. PATENT DOCUMENTS

| | | | |
|---|---|---|---|
| 2,946,565 | A | 7/1960 | Williams |
| 3,595,075 | A | 7/1971 | Dower |
| 3,603,409 | A | 9/1971 | Watkins |
| 3,677,353 | A | 7/1972 | Baker |
| 3,815,673 | A | 6/1974 | Bruce et al. |
| 3,958,651 | A | 5/1976 | Young |
| 4,022,285 | A | 5/1977 | Frank |
| 4,049,066 | A | 9/1977 | Richey |
| 4,063,602 | A | 12/1977 | Howell et al. |
| 4,091,881 | A | 5/1978 | Maus |
| 4,099,583 | A | 7/1978 | Maus |
| 4,108,257 | A | 8/1978 | Sizer |
| 4,134,461 | A | 1/1979 | Blomsma |
| 4,137,975 | A | 2/1979 | Pennock |
| 4,149,603 | A | 4/1979 | Arnold |
| 4,210,208 | A | 7/1980 | Shanks |
| 4,223,747 | A | 9/1980 | Marais |
| 4,240,513 | A | 12/1980 | Castel et al. |
| 4,291,772 | A | 9/1981 | Beynet |
| 4,368,787 | A | 1/1983 | Messenger |
| 4,436,166 | A | 3/1984 | Hayatdavoudi et al. |
| 4,440,239 | A | 4/1984 | Evans |
| 4,534,426 | A | 8/1985 | Hooper |
| 4,613,003 | A | 9/1986 | Ruhle |
| 4,630,691 | A | 12/1986 | Hooper |
| 4,744,426 | A | 5/1988 | Reed |
| 4,813,495 | A | 3/1989 | Leach |
| 5,150,757 | A | 9/1992 | Nunley |
| 5,168,932 | A | 12/1992 | Worrall et al. |
| 5,355,967 | A | 10/1994 | Mueller et al. |
| 5,651,420 | A | 7/1997 | Tibbitts et al. |
| 5,775,443 | A | 7/1998 | Lott |
| 6,142,236 | A | 11/2000 | Brammer et al. |
| 6,216,799 | B1 | 4/2001 | Gonzalez |
| 6,276,455 | B1 | 8/2001 | Gonzalez |
| 6,374,925 | B1 | 4/2002 | Elkins et al. |
| 6,415,877 | B1 | 7/2002 | Fincher et al. |
| 6,527,513 | B1 | 3/2003 | Van Drentham-Susman et al. |
| 6,668,943 | B1 * | 12/2003 | Maus et al. ..... 175/5 |
| 6,719,071 | B1 | 4/2004 | Moyes |
| 6,896,075 | B2 * | 5/2005 | Haugen et al. ..... 175/57 |
| 7,090,023 | B2 * | 8/2006 | Haugen et al. ..... 166/381 |
| 2003/0146001 | A1 | 8/2003 | Hosie et al. |

FOREIGN PATENT DOCUMENTS

| | | |
|---|---|---|
| WO | WO 00/50731 | 8/2000 |
| WO | WO 02/14649 | 2/2002 |
| WO | WO 03/023182 A1 | 3/2003 |

OTHER PUBLICATIONS

*Technologies Manage Well Pressures*, Don M. Hannegan, Ron Divine, The American Oil & Gas Reporter, Sep. 2001.

*Continuous Circulation Drilling*, L.J. Ayling, Maris Int'l Ltd.; J.W. Jenner, Maris Int'l Ltd., H. elkins, Varco Drilling Equipment, this paper prepared for presentaion at the 2002 Offshore Technology Conference, Houston, Texas May 6-9, 2002.

* cited by examiner

CONTROL SYSTEMS AND METHODS FOR ACTIVE CONTROLLED BOTTOMHOLE PRESSURE SYSTEMS

CROSS-REFERENCE TO RELATED APPLICATIONS

This application is a continuation-in-part of U.S. patent application Ser. No. 10/783,471 filed Feb. 20$^{th}$, 2004 now U.S. Pat. No. 7,114,581, which is a continuation of U.S. patent application Ser. No. 10/251,138 filed Sep. 20$^{th}$, 2002 now abandoned, which takes priority from U.S. provisional patent application Ser. No. 60/323,803 filed on Sep. 20, 2001, titled "Active Controlled Bottomhole Pressure System and Method."

This application is a continuation-in-part of U.S. patent application Ser. No. 10/716,106 filed on Nov. 17$^{th}$, 2003 now U.S. Pat. No. 6,854,532, which is a continuation of U.S. patent application Ser. No. 10/094,208, filed Mar. 8, 2002, now U.S. Pat. No. 6,648,081 granted on Nov. 18, 2003, which is a continuation of U.S. application Ser. No. 09/353,275, filed Jul. 14, 1999, now U.S. Pat. No. 6,415,877, which claims benefit of U.S. Provisional Application No. 60/108,601, filed Nov. 16, 1998, U.S. Provisional Application No. 60/101,541, filed Sep. 23, 1998, U.S. Provisional Application No. 60/092,908, filed, Jul. 15, 1998 and U.S. Provisional Application No. 60/095,188, filed Aug. 3, 1998.

FIELD OF THE INVENTION

This invention relates generally to oilfield wellbore drilling systems and more particularly to drilling systems that utilize active control of bottomhole pressure or equivalent circulating density during drilling of the wellbores.

BACKGROUND OF THE ART

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. The drill pipe is made of jointed pipes. Alternatively, coiled tubing may be utilized to carry the drilling of assembly. The drilling assembly usually includes a drilling motor or a "mud motor" that rotates the drill bit. The drilling assembly also includes a variety of sensors for taking measurements of a variety of drilling, formation and BHA parameters. A suitable drilling fluid (commonly referred to as the "mud") is supplied or pumped under pressure from a source at the surface down the tubing. The drilling fluid drives the mud motor and then discharges at the bottom of the drill bit. The drilling fluid returns uphole via the annulus between the drill string and the wellbore inside and carries with it pieces of formation (commonly referred to as the "cuttings") cut or produced by the drill bit in drilling the wellbore.

For drilling wellbores under water (referred to in the industry as "offshore" or "subsea" drilling) tubing is provided at a work station (located on a vessel or platform). One or more tubing injectors or rigs are used to move the tubing into and out of the wellbore. In riser-type drilling, a riser, which is formed by joining sections of casing or pipe, is deployed between the drilling vessel and the wellhead equipment at the sea bottom and is utilized to guide the tubing to the wellhead. The riser also serves as a conduit for fluid returning from the wellhead to the sea surface.

During drilling, the drilling operator attempts to carefully control the fluid density at the surface so as to control pressure in the wellbore, including the bottomhole pressure. Typically, the operator maintains the hydrostatic pressure of the drilling fluid in the wellbore above the formation or pore pressure to avoid well blow-out. The density of the drilling fluid and the fluid flow rate largely determine the effectiveness of the drilling fluid to carry the cuttings to the surface. One important downhole parameter controlled during drilling is the bottomhole pressure, which in turn controls the equivalent circulating density ("ECD") of the fluid at the wellbore bottom.

This term, ECD, describes the condition that exists when the drilling mud in the well is circulated. The friction pressure caused by the fluid circulating through the open hole and the casing(s) on its way back to the surface, causes an increase in the pressure profile along this path that is different from the pressure profile when the well is in a static condition (i.e., not circulating). In addition to the increase in pressure while circulating, there is an additional increase in pressure while drilling due to the introduction of drill solids into the fluid. This negative effect of the increase in pressure along the annulus of the well is an increase of the pressure which can fracture the formation at the shoe of the last casing. This can reduce the amount of hole that can be drilled before having to set an additional casing. In addition, the rate of circulation that can be achieved is also limited. Also, due to this circulating pressure increase, the ability to clean the hole is severely restricted. This condition is exacerbated when drilling an offshore well. In offshore wells, the difference between the fracture pressures in the shallow sections of the well and the pore pressures of the deeper sections is considerably smaller compared to on shore wellbores. This is due to the seawater gradient versus the gradient that would exist if there were soil overburden for the same depth.

In some drilling applications, it is desired to drill the wellbore at at-balance condition or at under-balanced condition. The term at-balance means that the pressure in the wellbore is maintained at or near the formation pressure. The under-balanced condition means that the wellbore pressure is below the formation pressure. These two conditions are desirable because the drilling fluid under such conditions does not penetrate into the formation, thereby leaving the formation virgin for performing formation evaluation tests and measurements. In order to be able to drill a well to a total wellbore depth at the bottomhole, ECD must be reduced or controlled. In subsea wells, one approach is to use a mud-filled riser to form a subsea fluid circulation system utilizing the tubing, BHA, the annulus between the tubing and the wellbore and the mud filled riser, and then inject gas (or some other low density liquid) in the primary drilling fluid (typically in the annulus adjacent the BHA) to reduce the density of fluid downstream (i.e., in the remainder of the fluid circulation system). This so-called "dual density" approach is often referred to as drilling with compressible fluids.

Another method for changing the density gradient in a deepwater return fluid path has been proposed, but not used in practical application. This approach proposes to use a tank, such as an elastic bag, at the sea floor for receiving return fluid from the wellbore annulus and holding it at the hydrostatic pressure of the water at the sea floor. Independent of the flow in the annulus, a separate return line connected to the sea floor storage tank and a subsea lifting pump delivers the return fluid to the surface. Although this technique (which is referred to as "dual gradient" drilling)

would use a single fluid, it would also require a discontinuity in the hydraulic gradient line between the sea floor storage tank and the subsea lifting pump. This requires close monitoring and control of the pressure at the subsea storage tank, subsea hydrostatic water pressure, subsea lifting pump operation and the surface pump delivering drilling fluids under pressure into the tubing for flow downhole. The level of complexity of the required subsea instrumentation and controls as well as the difficulty of deployment of the system has delayed (if not altogether prevented) the practical application of the "dual gradient" system.

Another approach is described in U.S. patent application Ser. No. 09/353,275, filed on Jul. 14, 1999 and assigned to the assignee of the present application. The U.S. patent application Ser. No. 09/353,275 is incorporated herein by reference in its entirety. One embodiment of this application describes a riser less system wherein a centrifugal pump in a separate return line controls the fluid flow to the surface and thus the equivalent circulating density.

The present invention provides a wellbore system wherein the bottomhole pressure and hence the equivalent circulating density is controlled by creating a pressure differential at a selected location in the return fluid path with an active pressure differential device to reduce or control the bottomhole pressure. The present system is relatively easy to incorporate in new and existing systems.

SUMMARY OF THE INVENTION

The present invention provides wellbore systems for performing downhole wellbore operations for both land and offshore wellbores. Such drilling systems include a rig that moves an umbilical (e.g., drill string) into and out of the wellbore. A bottomhole assembly, carrying the drill bit, is attached to the bottom end of the drill string. A well control assembly or equipment on the well receives the bottomhole assembly and the tubing. A drilling fluid system supplies a drilling fluid into the tubing, which discharges at the drill bit and returns to the well control equipment carrying the drill cuttings via the annulus between the drill string and the wellbore. A riser dispersed between the wellhead equipment and the surface guides the drill string and provides a conduit for moving the returning fluid to the surface.

In one embodiment of the present invention, an active pressure differential device moves in the wellbore as the drill string is moved. In an alternative embodiment, the active differential pressure device is attached to the wellbore inside or wall and remains stationary relative to the wellbore during drilling. The device is operated during drilling, i.e., when the drilling fluid is circulating through the wellbore, to create a pressure differential across the device. This pressure differential alters the pressure on the wellbore below or downhole of the device. The device may be controlled to reduce the bottomhole pressure by a certain amount, to maintain the bottomhole pressure at a certain value, or within a certain range. By severing or restricting the flow through the device, the bottomhole pressure may be increased.

The system also includes downhole devices for performing a variety of functions. Exemplary downhole devices include devices that control the drilling flow rate and flow paths. For example, the system can include one or more flow-control devices that can stop the flow of the fluid in the drill string and/or the annulus. Such flow-control devices can be configured to direct fluid in drill string into the annulus and/or bypass return fluid around the APD device. Another exemplary downhole device can be configured for processing the cuttings (e.g., reduction of cutting size) and other debris flowing in the annulus. For example, a comminution device can be disposed in the annulus upstream of the APD device.

In a preferred embodiment, sensors communicate with a controller via a telemetry system to maintain the wellbore pressure at a zone of interest at a selected pressure or range of pressures. The sensors are strategically positioned throughout the system to provide information or data relating to one or more selected parameters of interest such as drilling parameters, drilling assembly or BHA parameters, and formation or formation evaluation parameters. The controller for suitable for drilling operations preferably includes programs for maintaining the wellbore pressure at zone at under-balance condition, at at-balance condition or at over-balanced condition. The controller may be programmed to activate downhole devices according to programmed instructions or upon the occurrence of a particular condition.

Exemplary configurations for the APD Device and associated drive includes a moineau-type pump coupled to positive displacement motor/drive via a shaft assembly. Another exemplary configuration includes a turbine drive coupled to a centrifugal-type pump via a shaft assembly. Preferably, a high-pressure seal separates a supply fluid flowing through the motor from a return fluid flowing through the pump. In a preferred embodiment, the seal is configured to bear either or both of radial and axial (thrust) forces.

In still other configurations, a positive displacement motor can drive an intermediate device such as a hydraulic motor, which drives the APD Device. Alternatively, a jet pump can be used, which can eliminate the need for a drive/motor. Moreover, pumps incorporating one or more pistons, such as hammer pumps, may also be suitable for certain applications. In still other configurations, the APD Device can be driven by an electric motor. The electric motor can be positioned external to a drill string or formed integral with a drill string. In a preferred arrangement, varying the speed of the electrical motor directly controls the speed of the rotor in the APD device, and thus the pressure differential across the APD Device.

Bypass devices are provided to allow fluid circulation in the wellbore during tripping of the system, to control the operating set points of the APD Device and/or associated drive/motor, and to provide a discharge mechanism to relieve fluid pressure. For examples, the bypass devices can selectively channel fluid around the motor/drive and the APD Device and selectively discharge drilling fluid from the drill string into the annulus. In one arrangement, the bypass device for the pump can also function as a particle bypass line for the APD device. Alternatively, a separate particle bypass can be used in addition to the pump bypass for such a function. Additionally, an annular seal (not shown) in certain embodiments can be disposed around the APD device to enable a pressure differential across the APD Device.

In certain embodiments, the present invention further provides a method of controlling pressure in a wellbore by controlling the APD Device to provide a wellbore pressure relative to a formation pressure parameter (e.g., pore pressure, collapse pressure, fracture pressure, etc.) at a selected location in the wellbore. Operating parameters for the APD Device such as flow rate, speed, and pressure can be adjusted to cause the APD Device to provide a selected pressure differential in the return fluid. In one method, the operating parameter is set at the surface. In other methods, one or more of the operating parameters are adjusted during operation of the APD Device by a control unit. In one embodiment, a control unit operates an adjustable bypass that selectively diverts drilling fluid around a motor for the APD Device or the APD Device itself to thereby control the pressure differential caused by the pump. In other embodiments, the adjustable bypass can discharges fluid from the supply line to the annulus. The control unit can also control the APD Device in response to at least one determined parameter relating to a selected fluid in the wellbore such as flow rate, density, temperature, and pressure.

In embodiments, the APD Device is controlled in response to a measured pressure differential between an inlet of the APD Device and an outlet of the APD Device. For instance, a control unit controls the APD Device to provide a pre-determined pressure differential between the APD Device inlet and outlet. In other arrangements, the APD device is controlled in response to a measured formation parameter such as pore pressure, fracture pressure, a geophysical property, a petrophysical property, and collapse pressure or a drilling parameter such as ROP, vibration, or flow rate.

The APD device can be configured to control pressure (or some other parameter) at the wellbore bottom or another location such as proximate to a casing shoe, at an open wellbore section uphole of the bottomhole assembly, or in a casing. For instance, the APD Device is controlled using wellbore pressure measurements to provide a specified pressure differential with respect to the pore pressure at an open hole adjacent a casing shoe. Such a pressure control arrangement may be advantageous when the APD Device in a casing in the wellbore. The wellbore pressure at the casing shoe can, in such an arrangement, be controlled to provide an over-balance, an at-balance, or under-balance. Also, in certain methods, two or more APD Devices are used to provide a selected pressure profile in the wellbore.

Examples of the more important features of the invention have been summarized (albeit rather broadly) in order that the detailed description thereof that follows may be better understood and in order that the contributions they represent to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawing.

DETAILED DESCRIPTION OF PREFERRED EMBODIMENTS

Figure 1A:
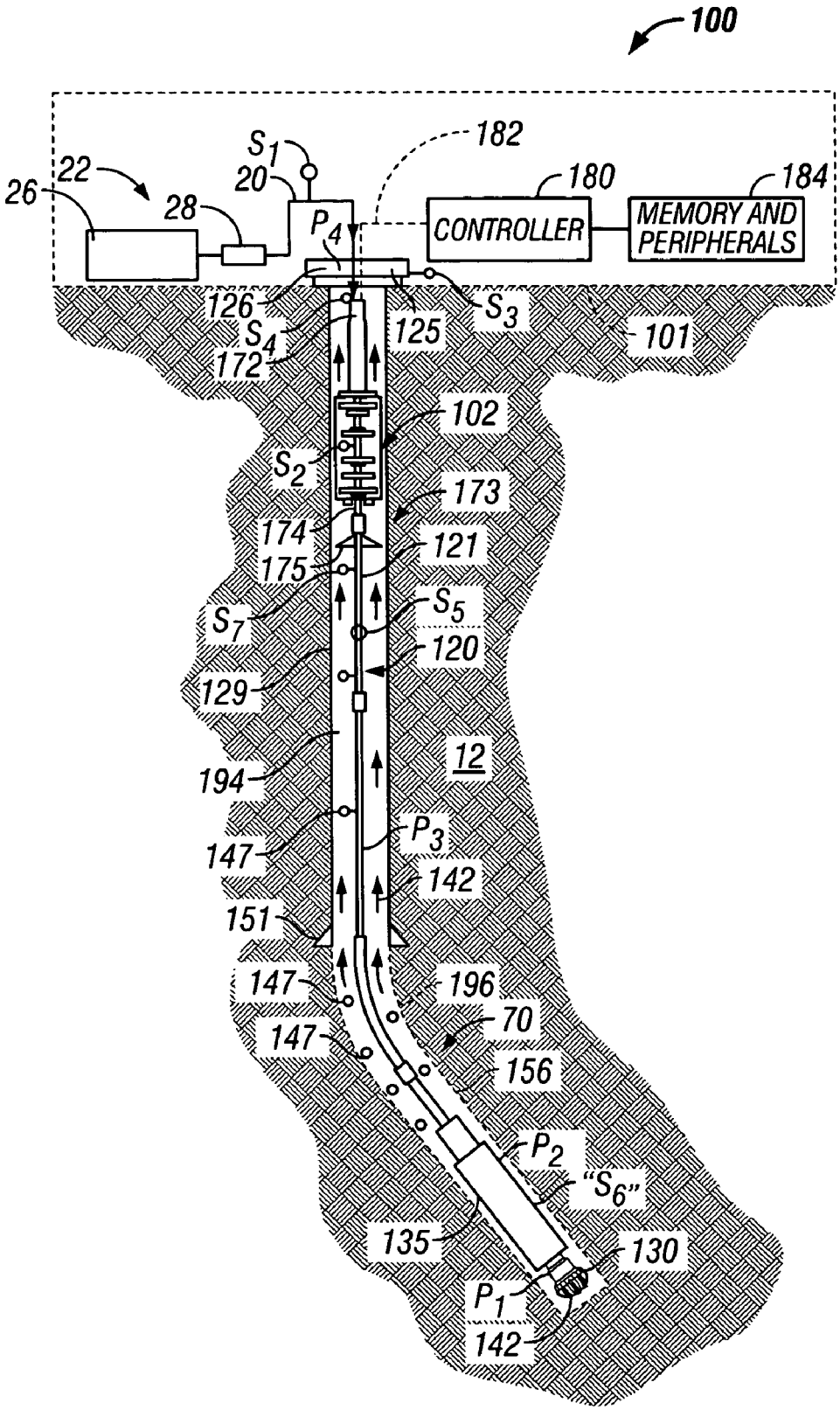
FIG. 1A is a schematic illustration of one embodiment of a system using an active pressure differential device to manage pressure in a predetermined wellbore location.

Referring initially to FIG. 1A, there is schematically illustrated a system for performing one or more operations related to the construction, logging, completion or workover of a hydrocarbon producing well. In particular, FIG. 1A shows a schematic elevation view of one embodiment of a wellbore drilling system 100 for drilling wellbore 90 using conventional drilling fluid circulation. The drilling system 100 is a rig for land wells and includes a drilling platform 101, which may be a drill ship or another suitable surface workstation such as a floating platform or a semi-submersible for offshore wells. For offshore operations, additional known equipment such as a riser and subsea wellhead will typically be used. To drill a wellbore 90, well control equipment 125 (also referred to as the wellhead equipment) is placed above the wellbore 90. The wellhead equipment 125 includes a blow-out-preventer stack 126 and a lubricator (not shown) with its associated flow control.

This system 100 further includes a well tool such as a drilling assembly or a bottomhole assembly ("BHA") 135 at the bottom of a suitable umbilical such as drill string or tubing 121 (such terms will be used interchangeably). In a preferred embodiment, the BHA 135 includes a drill bit 130 adapted to disintegrate rock and earth. The bit can be rotated by a surface rotary drive or a motor using pressurized fluid (e.g., mud motor) or an electrically driven motor. The tubing 121 can be formed partially or fully of drill pipe, metal or composite coiled tubing, liner, casing or other known members. Additionally, the tubing 121 can include data and power transmission carriers such fluid conduits, fiber optics, and metal conductors. Conventionally, the tubing 121 is placed at the drilling platform 101. To drill the wellbore 90, the BHA 135 is conveyed from the drilling platform 101 to the wellhead equipment 125 and then inserted into the wellbore 90. The tubing 121 is moved into and out of the wellbore 90 by a suitable tubing injection system.

During drilling, a drilling fluid from a surface mud system 22 is pumped under pressure down the tubing 121 (a "supply fluid"). The mud system 22 includes a mud pit or supply source 26 and one or more pumps 28. In one embodiment, the supply fluid operates a mud motor in the BHA 135, which in turn rotates the drill bit 130. The drill string 121 rotation can also be used to rotate the drill bit 130, either in conjunction with or separately from the mud motor. The drill bit 130 disintegrates the formation (rock) into cuttings 147. The drilling fluid leaving the drill bit travels uphole through the annulus 194 between the drill string 121 and the wellbore wall or inside 196, carrying the drill cuttings 147 therewith (a "return fluid"). The return fluid discharges into a separator (not shown) that separates the cuttings 147 and other solids from the return fluid and discharges the clean fluid back into the mud pit 26. As shown in FIG. 1A, the clean mud is pumped through the tubing 121 while the mud with cuttings 147 returns to the surface via the annulus 194 up to the wellhead equipment 125.

Once the well 90 has been drilled to a certain depth, casing 129 with a casing shoe 151 at the bottom is installed. The drilling is then continued to drill the well to a desired depth that will include one or more production sections, such as section 155. The section below the casing shoe 151 may not be cased until it is desired to complete the well, which leaves the bottom section of the well as an open hole, as shown by numeral 156.

As noted above, the present invention provides a drilling system for controlling bottomhole pressure at a zone of interest designated by the numeral 155 and thereby the ECD effect on the wellbore. In one embodiment of the present invention, to manage or control the pressure at the zone 155, an active pressure differential device ("APD Device") 170 is fluidicly coupled to return fluid downstream of the zone of interest 155. The active pressure differential device is a device that is capable of creating a pressure differential "ΔP" across the device. This controlled pressure drop reduces the pressure upstream of the APD Device 170 and particularly in zone 155.

The system 100 also includes downhole devices that separately or cooperatively perform one or more functions such as controlling the flow rate of the drilling fluid and controlling the flow paths of the drilling fluid. For example, the system 100 can include one or more flow-control devices that can stop the flow of the fluid in the drill string and/or the annulus 194. FIG. 1A shows an exemplary flow-control device 173 that includes a device 174 that can block the fluid flow within the drill string 121 and a device 175 that blocks can block fluid flow through the annulus 194. The device 173 can be activated when a particular condition occurs to insulate the well above and below the flow-control device 173. For example, the flow-control device 173 may be activated to block fluid flow communication when drilling fluid circulation is stopped so as to isolate the sections above and below the device 173, thereby maintaining the wellbore below the device 173 at or substantially at the pressure condition prior to the stopping of the fluid circulation.

The flow-control devices 174, 175 can also be configured to selectively control the flow path of the drilling fluid. For example, the flow-control device 174 in the drill pipe 121 can be configured to direct some or all of the fluid in drill string 121 into the annulus 194. Moreover, one or both of the flow-control devices 174, 175 can be configured to bypass some or all of the return fluid around the APD device 170. Such an arrangement may be useful, for instance, to assist in lifting cuttings to the surface. The flow-control device 173 may include check-valves, packers and any other suitable device. Such devices may automatically activate upon the occurrence of a particular event or condition.

The system 100 also includes downhole devices for processing the cuttings (e.g., reduction of cutting size) and other debris flowing in the annulus 194. For example, a comminution device 176 can be disposed in the annulus 194 upstream of the APD device 170 to reduce the size of entrained cutting and other debris. The comminution device 176 can use known members such as blades, teeth, or rollers to crush, pulverize or otherwise disintegrate cuttings and debris entrained in the fluid flowing in the annulus 194. The comminution device 176 can be operated by an electric motor, a hydraulic motor, by rotation of drill string or other suitable means. The comminution device 176 can also be integrated into the APD device 170. For instance, if a multi-stage turbine is used as the APD device 170, then the stages adjacent the inlet to the turbine can be replaced with blades adapted to cut or shear particles before they pass through the blades of the remaining turbine stages.

Sensors $S_{1-n}$ are strategically positioned throughout the system 100 to provide information or data relating to one or more selected parameters of interest (pressure, flow rate, temperature). In a preferred embodiment, the downhole devices and sensors $S_{1-n}$ communicate with a controller 180 via a telemetry system (not shown). Using data provided by the sensors $S_{1-n}$, the controller 180 maintains the wellbore pressure at zone 155 at a selected pressure or range of pressures. The controller 180 maintains the selected pressure by controlling the APD device 170 (e.g., adjusting amount of energy added to the return fluid line) and/or the downhole devices (e.g., adjusting flow rate through a restriction such as a valve).

When configured for drilling operations, the sensors $S_{1-n}$ provide measurements relating to a variety of drilling parameters, such as fluid pressure, fluid flow rate, rotational speed of pumps and like devices, temperature, weight-on bit, rate of penetration, etc., drilling assembly or BHA parameters, such as vibration, stick slip, RPM, inclination, direction, BHA location, etc. and formation or formation evaluation parameters commonly referred to as measurement-while-drilling parameters such as resistivity, acoustic, nuclear, NMR, etc. One preferred type of sensor is a pressure sensor for measuring pressure at one or more locations. Referring still to FIG. 1A, pressure sensor $P_1$ provides pressure data in the BHA, sensor $P_2$ provides pressure data in the annulus, pressure sensor $P_3$ in the supply fluid, and pressure sensor $P_4$ provides pressure data at the surface. Other pressure sensors may be used to provide pressure data at any other desired place in the system 100. Additionally, the system 100 includes fluid flow sensors such as sensor V that provides measurement of fluid flow at one or more places in the system.

Further, the status and condition of equipment as well as parameters relating to ambient conditions (e.g., pressure and other parameters listed above) in the system 100 can be monitored by sensors positioned throughout the system 100: exemplary locations including at the surface (S1), at the APD device 170 (S2), at the wellhead equipment 125 (S3), in the supply fluid (S4), along the tubing 121 (S5), at the well tool 135 (S6), in the return fluid upstream of the APD device 170 (S7), and in the return fluid downstream of the APD device 170 (S8). It should be understood that other locations may also be used for the sensors $S_{1-n}$.

The controller 180 for suitable for drilling operations preferably includes programs for maintaining the wellbore pressure at zone 155 at under-balance condition, at at-balance condition or at over-balanced condition. The controller 180 includes one or more processors that process signals from the various sensors in the drilling assembly and also controls their operation. The data provided by these sensors $S_{1-n}$ and control signals transmitted by the controller 180 to control downhole devices such as devices 173–176 are communicated by a suitable two-way telemetry system (not shown). A separate processor may be used for each sensor or device. Each sensor may also have additional circuitry for its unique operations. The controller 180, which may be either downhole or at the surface, is used herein in the generic sense for simplicity and ease of understanding and not as a limitation because the use and operation of such controllers is known in the art. The controller 180 preferably contains one or more microprocessors or micro-controllers for processing signals and data and for performing control functions, solid state memory units for storing programmed instructions, models (which may be interactive models) and data, and other necessary control circuits. The microprocessors control the operations of the various sensors, provide communication among the downhole sensors and provide two-way data and signal communication between the drilling assembly 30, downhole devices such as devices 173–175 and the surface equipment via the two-way telemetry. In other embodiments, the controller 180 can be a hydro-mechanical device that incorporates known mechanisms (valves, biased members, linkages cooperating to actuate tools under, for example, preset conditions).

For convenience, a single controller 180 is shown. It should be understood, however, that a plurality of controllers 180 can also be used. For example, a downhole controller can be used to collect, process and transmit data to a surface controller, which further processes the data and transmits appropriate control signals downhole. Other variations for dividing data processing tasks and generating control signals can also be used.

In general, however, during operation, the controller 180 receives the information regarding a parameter of interest and adjusts one or more downhole devices and/or APD device 170 to provide the desired pressure or range or pressure in the vicinity of the zone of interest 155. For example, the controller 180 can receive pressure information from one or more of the sensors ($S_1$-$S_n$) in the system 100. The controller 180 may control the APD Device 170 in response to one or more of: pressure, fluid flow, a formation characteristic, a wellbore characteristic and a fluid characteristic, a surface measured parameter or a parameter measured in the drill string. The controller 180 determines the ECD and adjusts the energy input to the APD device 170 to maintain the ECD at a desired or predetermined value or within a desired or predetermined range. The wellbore system 100 thus provides a closed loop system for controlling the ECD in response to one or more parameters of interest during drilling of a wellbore. This system is relatively simple and efficient and can be incorporated into new or existing drilling systems and readily adapted to support other well construction, completion, and work-over activities.

In the embodiment shown in FIG. 1A, the APD Device 170 is shown as a turbine attached to the drill string 121 that operates within the annulus 194. Other embodiments, described in further detail below can include centrifugal pumps, positive displacement pump, jet pumps and other like devices. During drilling, the APD Device 170 moves in the wellbore 90 along with the drill string 121. The return fluid can flow through the APD Device 170 whether or not the turbine is operating. However, the APD Device 170, when operated creates a differential pressure thereacross.

As described above, the system 100 in one embodiment includes a controller 180 that includes a memory and peripherals 184 for controlling the operation of the APD Device 170, the devices 173–176, and/or the bottomhole assembly 135. In FIG. 1A, the controller 180 is shown placed at the surface. It, however, may be located adjacent the APD Device 170, in the BHA 135 or at any other suitable location. The controller 180 controls the APD Device to create a desired amount of ΔP across the device, which alters the bottomhole pressure accordingly. Alternatively, the controller 180 may be programmed to activate the flow-control device 173 (or other downhole devices) according to programmed instructions or upon the occurrence of a particular condition. Thus, the controller 180 can control the APD Device in response to sensor data regarding a parameter of interest, according to programmed instructions provided to said APD Device, or in response to instructions provided to said APD Device from a remote location. The controller 180 can, thus, operate autonomously or interactively.

During drilling, the controller 180 controls the operation of the APD Device to create a certain pressure differential across the device so as to alter the pressure on the formation or the bottomhole pressure. The controller 180 may be programmed to maintain the wellbore pressure at a value or range of values that provide an under-balance condition, an at-balance condition or an over-balanced condition. In one embodiment, the differential pressure may be altered by altering the speed of the APD Device. For instance, the bottomhole pressure may be maintained at a preselected value or within a selected range relative to a parameter of interest such as the formation pressure. The controller 180 may receive signals from one or more sensors in the system 100 and in response thereto control the operation of the APD Device to create the desired pressure differential. The controller 180 may contain pre-programmed instructions and autonomously control the APD Device or respond to signals received from another device that may be remotely located from the APD Device.

Figure 1B:
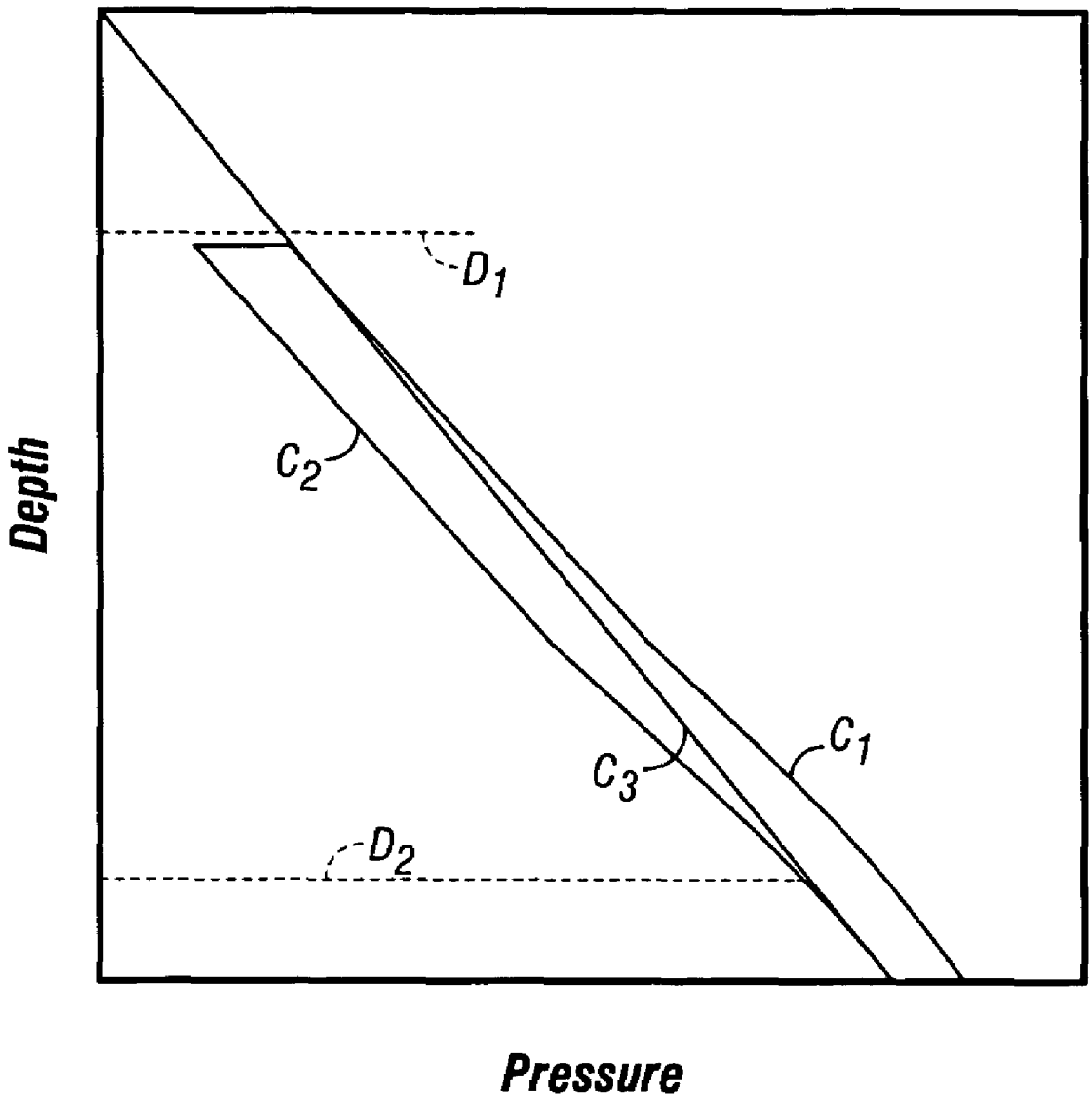
FIG. 1B graphically illustrates the effect of an operating active pressure differential device upon the pressure at a predetermined wellbore location.

FIG. 1B graphically illustrates the ECD control provided by the above-described embodiment of the present invention and references FIG. 1A for convenience. FIG. 1A shows the APD device 170 at a depth D1 and a representative location in the wellbore in the vicinity of the well tool 30 at a lower depth D2. FIG. 1B provides a depth versus pressure graph having a first curve C1 representative of a pressure gradient before operation of the system 100 and a second curve C2 representative of a pressure gradients during operation of the system 100. Curve C3 represents a theoretical curve wherein the ECD condition is not present; i.e., when the well is static and not circulating and is free of drill cuttings. It will be seen that a target or selected pressure at depth D2 under curve C3 cannot be met with curve C1. Advantageously, the system 100 reduces the hydrostatic pressure at depth D1 and thus shifts the pressure gradient as shown by curve C3, which can provide the desired predetermined pressure at depth D2. In most instances, this shift is roughly the pressure drop provided by the APD device 170.

Figure 2:
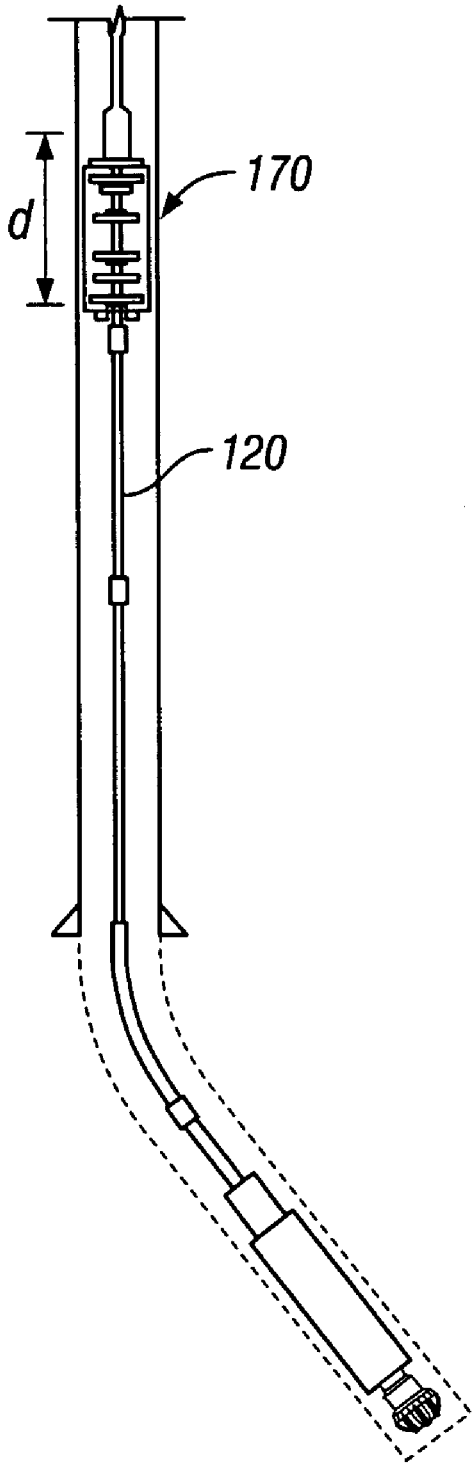
FIG. 2 is a schematic elevation view of FIG. 1A after the drill string and the active pressure differential device have moved a certain distance in the earth formation from the location shown in FIG. 1A.

FIG. 2 shows the drill string after it has moved the distance "d" shown by $t_1$-$t_2$. Since the APD Device 170 is attached to the drill string 121, the APD Device 170 also is shown moved by the distance d.

Figure 3:
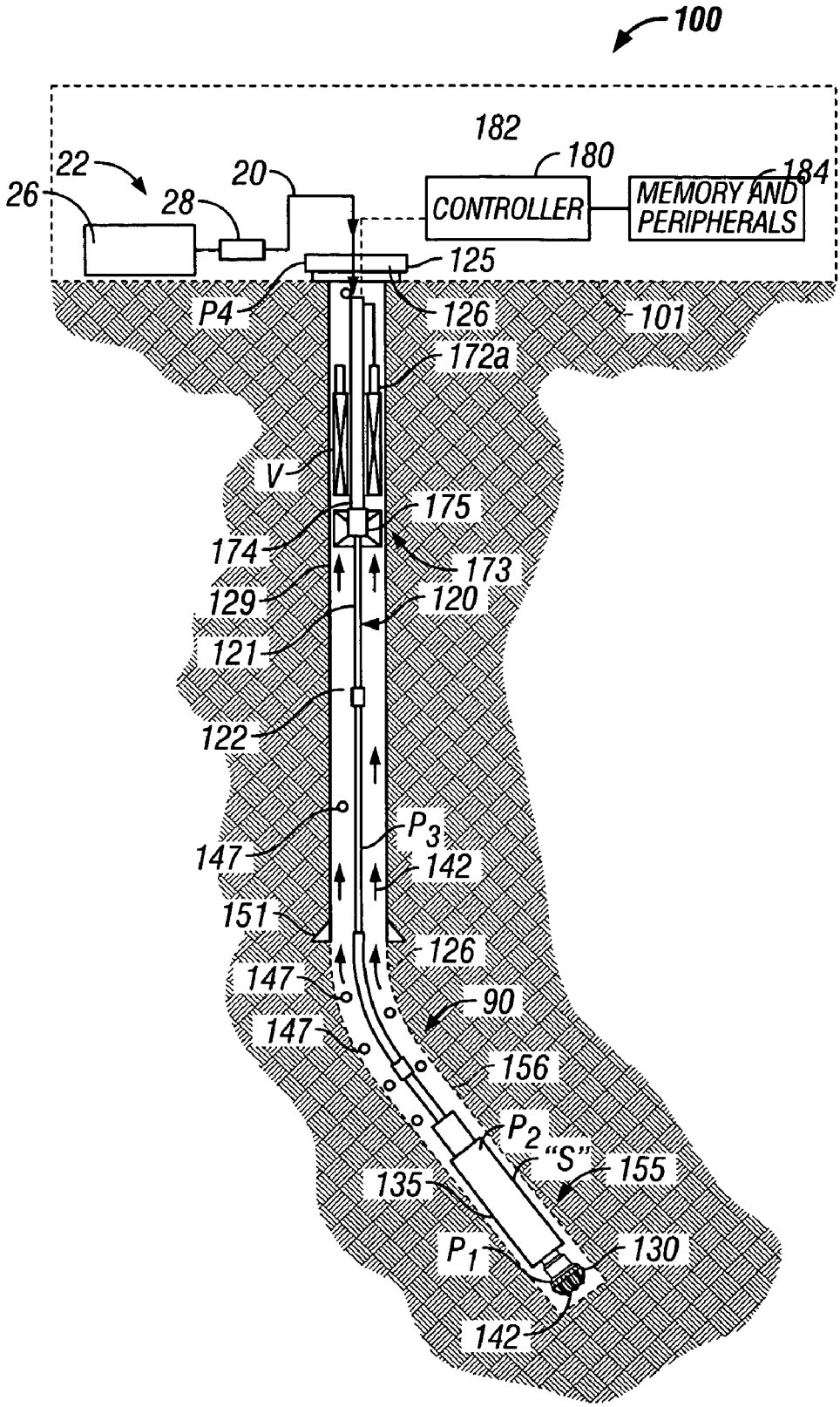
FIG. 3 is a schematic elevation view of an alternative embodiment of the wellbore system wherein the active pressure differential device is attached to the wellbore inside.
Figure 4A:
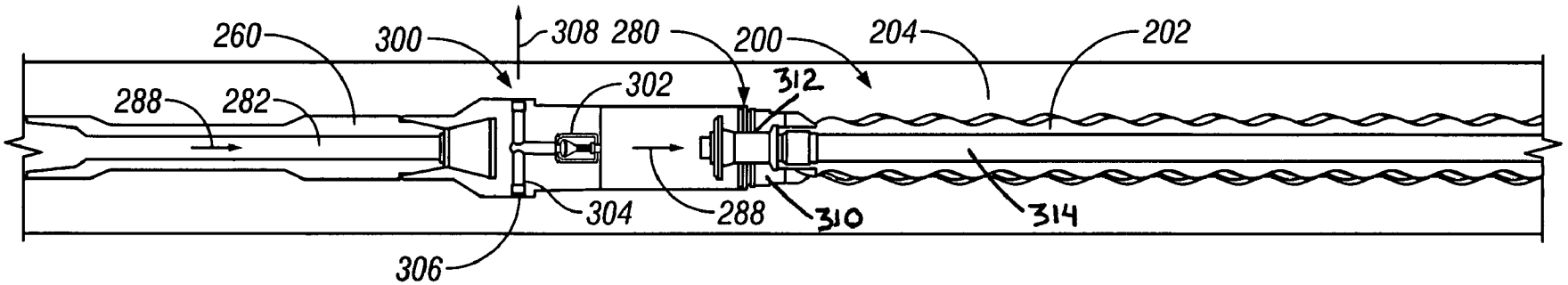
FIGS. 4A–D are schematic illustrations of one embodiment of an arrangement according to the present invention wherein a positive displacement motor is coupled to a positive displacement pump (the APD Device)
Figure 4B:
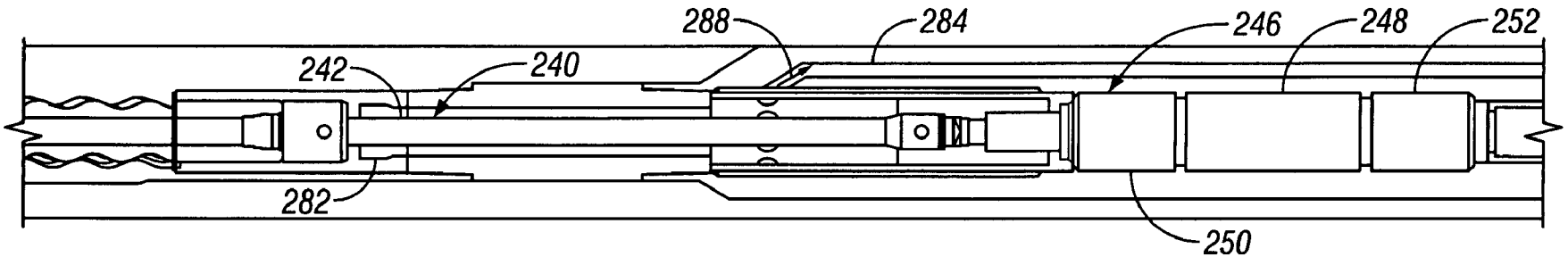
Figure 4C:
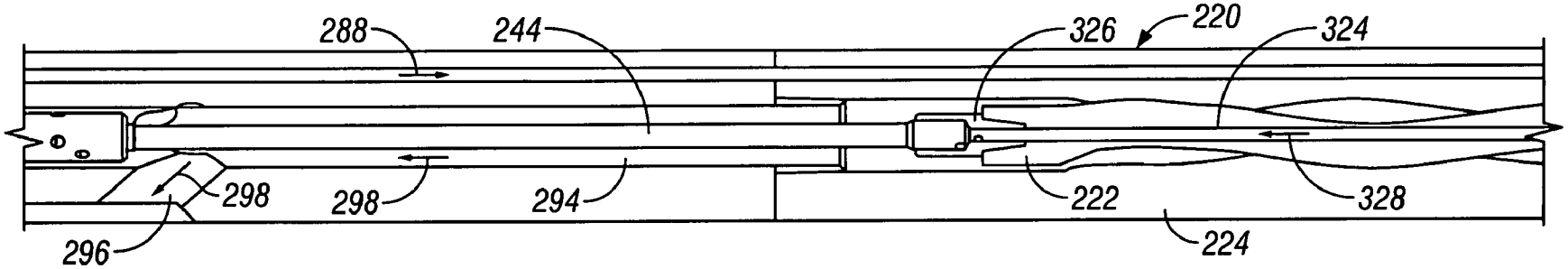
Figure 4D:
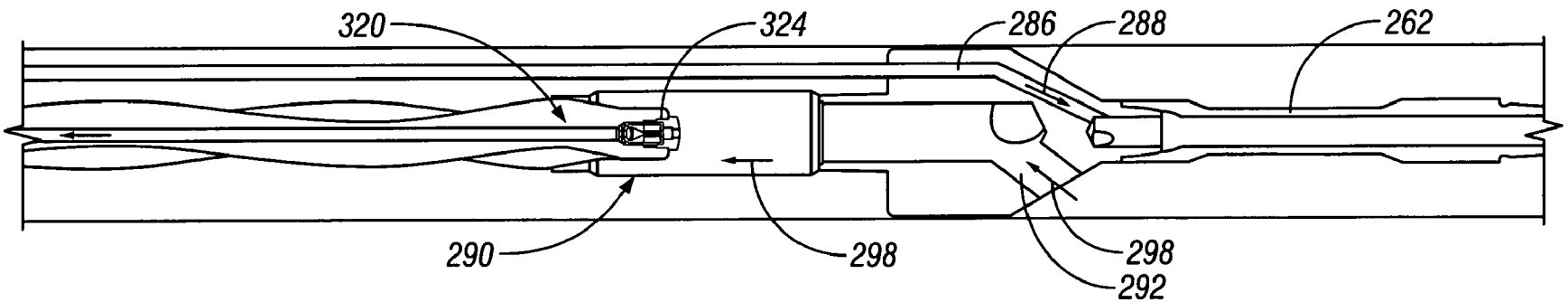

As noted earlier and shown in FIG. 2, an APD Device 170*a* may be attached to the wellbore in a manner that will allow the drill string 121 to move while the APD Device 170*a* remains at a fixed location. FIG. 3 shows an embodiment wherein the APD Device is attached to the wellbore inside and is operated by a suitable device 172*a*. Thus, the APD device can be attached to a location stationary relative to said drill string such as a casing, a liner, the wellbore annulus, a riser, or other suitable wellbore equipment. The APD Device 170*a* is preferably installed so that it is in a cased upper section 129. The device 170*a* is controlled in the manner described with respect to the device 170 (FIG. 1A).

Referring now to FIGS. 4A–D, there is schematically illustrated one arrangement wherein a positive displacement motor/drive 200 is coupled to a moineau-type pump 220 via a shaft assembly 240. The motor 200 is connected to an upper string section 260 through which drilling fluid is pumped from a surface location. The pump 220 is connected to a lower drill string section 262 on which the bottomhole assembly (not shown) is attached at an end thereof. The motor 200 includes a rotor 202 and a stator 204. Similarly, the pump 220 includes a rotor 222 and a stator 224. The design of moineau-type pumps and motors are known to one skilled in the art and will not be discussed in further detail.

The shaft assembly 240 transmits the power generated by the motor 200 to the pump 220. One preferred shaft assembly 240 includes a motor flex shaft 242 connected to the motor rotor 202, a pump flex shaft 244 connected to the pump rotor 224, and a coupling shaft 246 for joining the first and second shafts 242 and 244. In one arrangement, a high-pressure seal 248 is disposed about the coupling shaft 246. As is known, the rotors for moineau-type motors/pump are subject to eccentric motion during rotation. Accordingly, the coupling shaft 246 is preferably articulated or formed sufficiently flexible to absorb this eccentric motion. Alternately or in combination, the shafts 242, 244 can be configured to flex to accommodate eccentric motion. Radial and axial forces can be borne by bearings 250 positioned along the shaft assembly 240. In a preferred embodiment, the seal 248 is configured to bear either or both of radial and axial (thrust) forces. In certain arrangements, a speed or torque converter 252 can be used to convert speed/torque of the motor 200 to a second speed/torque for the pump 220. By speed/torque converter it is meant known devices such as variable or fixed ratio mechanical gearboxes, hydrostatic torque converters, and a hydrodynamic converters. It should be understood that any number of arrangements and devices can be used to transfer power, speed, or torque from the motor 200 to the pump 220. For example, the shaft assembly 240 can utilize a single shaft instead of multiple shafts.

As described earlier, a comminution device can be used to process entrained cutting in the return fluid before it enters the pump 200. Such a comminution device (FIG. 1A) can be coupled to the drive 200 or pump 220 and operated thereby. For instance, one such comminution device or cutting mill 270 can include a shaft 272 coupled to the pump rotor 224. The shaft 272 can include a conical head or hammer element 274 mounted thereon. During rotation, the eccentric motion of the pump rotor 224 will cause a corresponding radial motion of the shaft head 274. This radial motion can be used to resize the cuttings between the rotor and a comminution device housing 276.

The FIGS. 4A–D arrangement also includes a supply flow path 290 to carry supply fluid from the device 200 to the lower drill string section 262 and a return flow path 292 to channel return fluid from the casing interior or annulus into and out of the pump 220. The high pressure seal 248 is interposed between the flow paths 290 and 292 to prevent fluid leaks, particularly from the high pressure fluid in the supply flow path 290 into the return flow path 292. The seal 248 can be a high-pressure seal, a hydrodynamic seal or other suitable seal and formed of rubber, an elastomer, metal or composite.

Additionally, bypass devices are provided to allow fluid circulation during tripping of the downhole devices of the system 100 (FIG. 1A), to control the operating set points of the motor 200 and pump 220, and to provide safety pressure relief along either or both of the supply flow path 290 and the return flow path 292. Exemplary bypass devices include a circulation bypass 300, motor bypass 310, and a pump bypass 320.

The circulation bypass 300 selectively diverts supply fluid into the annulus 194 (FIG. 1A) or casing C interior. The circulation bypass 300 is interposed generally between the upper drill string section 260 and the motor 200. One preferred circulation bypass 300 includes a biased valve member 302 that opens when the flow-rate drops below a predetermined valve. When the valve 302 is open, the supply fluid flows along a channel 304 and exits at ports 306. More generally, the circulation bypass can be configured to actuate upon receiving an actuating signal and/or detecting a predetermined value or range of values relating to a parameter of interest (e.g., flow rate or pressure of supply fluid or operating parameter of the bottomhole assembly). The circulation bypass 300 can be used to facilitate drilling operations and to selective increase the pressure/flow rate of the return fluid.

The motor bypass 310 selectively channels conveys fluid around the motor 200. The motor bypass 310 includes a valve 312 and a passage 314 formed through the motor rotor 202. A joint 316 connecting the motor rotor 202 to the first shaft 242 includes suitable passages (not shown) that allow the supply fluid to exit the rotor passage 314 and enter the supply flow path 290. Likewise, a pump bypass 320 selectively conveys fluid around the pump 220. The pump bypass includes a valve and a passage formed through the pump rotor 222 or housing. The pump bypass 320 can also be configured to function as a particle bypass line for the APD device. For example, the pump bypass can be adapted with known elements such as screens or filters to selectively convey cuttings or particles entrained in the return fluid that are greater than a predetermined size around the APD device. Alternatively, a separate particle bypass can be used in addition to the pump bypass for such a function. Alternately, a valve (not shown) in a pump housing 225 can divert fluid to a conduit parallel to the pump 220. Such a valve can be configured to open when the flow rate drops below a predetermined value. Further, the bypass device can be a design internal leakage in the pump. That is, the operating point of the pump 220 can be controlled by providing a preset or variable amount of fluid leakage in the pump 220. Additionally, pressure valves can be positioned in the pump 220 to discharge fluid in the event an overpressure condition or other predetermined condition is detected.

Additionally, an annular seal 299 in certain embodiments can be disposed around the APD device to direct the return fluid to flow into the pump 220 (or more generally, the APD device) and to allow a pressure differential across the pump 220. The seal 299 can be a solid or pliant ring member, an expandable packer type element that expands/contracts upon receiving a command signal, or other member that substantially prevents the return fluid from flowing between the pump 220 (or more generally, the APD device) and the casing or wellbore wall. In certain applications, the clearance between the APD device and adjacent wall (either casing or wellbore) may be sufficiently small as to not require an annular seal.

During operation, the motor 200 and pump 220 are positioned in a well bore location such as in a casing C. Drilling fluid (the supply fluid) flowing through the upper drill string section 260 enters the motor 200 and causes the rotor 202 to rotate. This rotation is transferred to the pump rotor 222 by the shaft assembly 240. As is known, the respective lobe profiles, size and configuration of the motor 200 and the pump 220 can be varied to provide a selected speed or torque curve at given flow-rates. Upon exiting the motor 200, the supply fluid flows through the supply flow path 290 to the lower drill string section 262, and ultimately the bottomhole assembly (not shown). The return fluid flows up through the wellbore annulus (not shown) and casing C and enters the cutting mill 270 via a inlet 293 for the return flow path 292. The flow goes through the cutting mill 270 and enters the pump 220. In this embodiment, the controller 180 (FIG. 1A) can be programmed to control the speed of the motor 200 and thus the operation of the pump 220 (the APD Device in this instance).

It should be understood that the above-described arrangement is merely one exemplary use of positive displacement motors and pumps. For example, while the positive displacement motor and pump are shown in structurally in series in FIGS. 4A–D, a suitable arrangement can also have a positive displacement motor and pump in parallel. For example, the motor can be concentrically disposed in a pump.

Figure 5A:
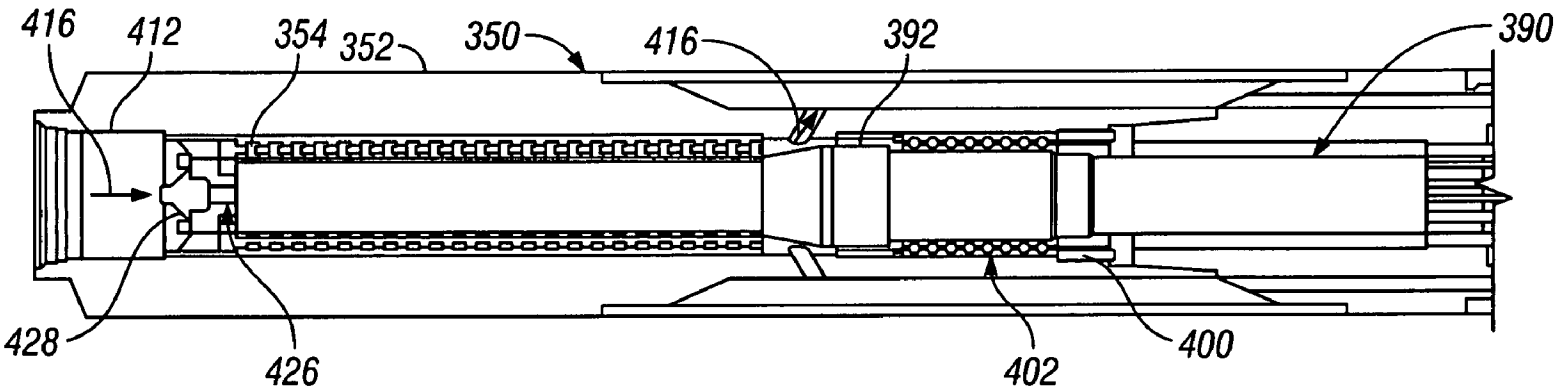
FIGS. 5A and 5B are schematic illustrations of one embodiment of an arrangement according to the present invention wherein a turbine drive is coupled to a centrifugal pump (the APD Device)
Figure 5B:
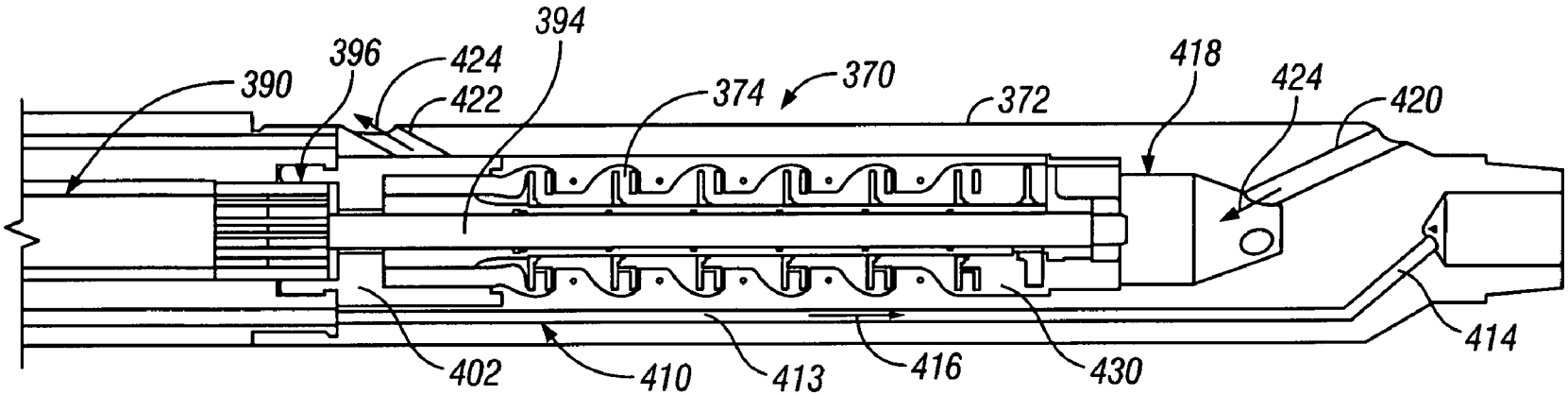

Referring now to FIGS. 5A–B, there is schematically illustrated one arrangement wherein a turbine drive 350 is coupled to a centrifugal-type pump 370 via a shaft assembly 390. The turbine 350 includes stationary and rotating blades 354 and radial bearings 402. The centrifugal-type pump 370 includes a housing 372 and multiple impeller stages 374. The design of turbines and centrifugal pumps are known to one skilled in the art and will not be discussed in further detail.

The shaft assembly 390 transmits the power generated by the turbine 350 to the centrifugal pump 370. One preferred shaft assembly 350 includes a turbine shaft 392 connected to the turbine blade assembly 354, a pump shaft 394 connected to the pump impeller stages 374, and a coupling 396 for joining the turbine and pump shafts 392 and 394.

The FIG. 5A–B arrangement also includes a supply flow path 410 for channeling supply fluid shown by arrows designated 416 and a return flow path 418 to channel return fluid shown by arrows designated 424. The supply flow path 410 includes an inlet 412 directing supply fluid into the turbine 350 and an axial passage 413 that conveys the supply fluid exiting the turbine 350 to an outlet 414. The return flow path 418 includes an inlet 420 that directs return fluid into the centrifugal pump 370 and an outlet 422 that channels the return fluid into the casing C interior or wellbore annulus. A high pressure seal 400 is interposed between the flow paths 410 and 418 to reduce fluid leaks, particularly from the high pressure fluid in the supply flow path 410 into the return flow path 418. A small leakage rate is desired to cool and lubricate the axial and radial bearings. Additionally, a bypass 426 can be provided to divert supply fluid from the turbine 350. Moreover, radial and axial forces can be borne by bearing assemblies 402 positioned along the shaft assembly 390. Preferably a comminution device 373 is provided to reduce particle size entering the centrifugal pump 370. In a preferred embodiment, one of the impeller stages is modified with shearing blades or elements that shear entrained particles to reduce their size. In certain arrangements, a speed or torque converter 406 can be used to convert a first speed/torque of the motor 350 to a second speed/torque for the centrifugal pump 370. It should be understood that any number of arrangements and devices can be used to transfer power, speed, or torque from the turbine 350 to the pump 370. For example, the shaft assembly 390 can utilize a single shaft instead of multiple shafts.

It should be appreciated that a positive displacement pump need not be matched with only a positive displacement motor, or a centrifugal pump with only a turbine. In certain applications, operational speed or space considerations may lend itself to an arrangement wherein a positive displacement drive can effectively energize a centrifugal pump or a turbine drive energize a positive displacement pump. It should also be appreciated that the present invention is not limited to the above-described arrangements. For example, a positive displacement motor can drive an intermediate device such as an electric motor or hydraulic motor provided with an encapsulated clean hydraulic reservoir. In such an arrangement, the hydraulic motor (or produced electric power) drives the pump. These arrangements can eliminate the leak paths between the high-pressure supply fluid and the return fluid and therefore eliminates the need for high-pressure seals. Alternatively, a jet pump can be used. In an exemplary arrangement, the supply fluid is divided into two streams. The first stream is directed to the BHA. The second stream is accelerated by a nozzle and discharged with high velocity into the annulus, thereby effecting a reduction in annular pressure. Pumps incorporating one or more pistons, such as hammer pumps, may also be suitable for certain applications.

Figure 6A:
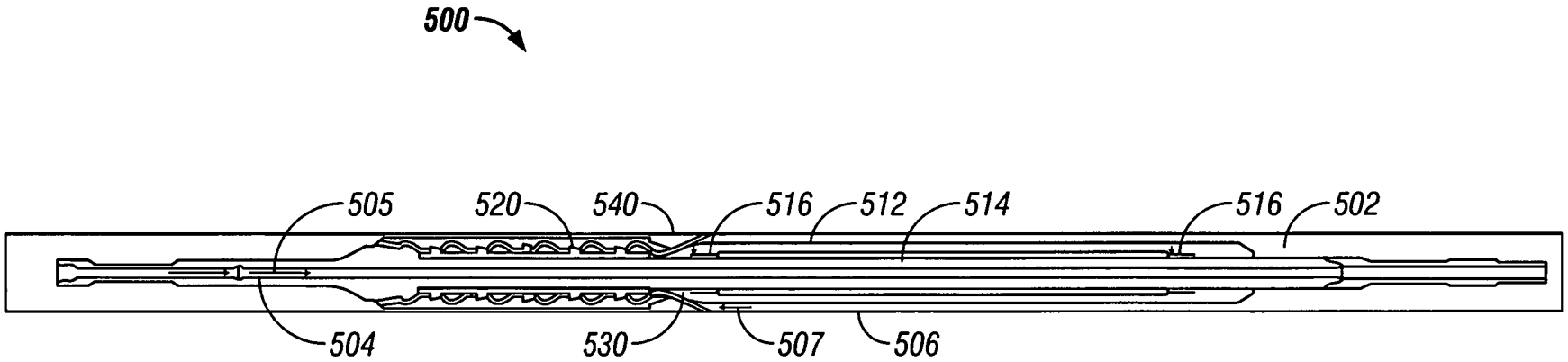
FIG. 6A is a schematic illustration of an embodiment of an arrangement according to the present invention wherein an electric motor disposed on the outside of a drill string is coupled to an APD Device.

Referring now to FIG. 6A, there is schematically illustrated one arrangement wherein an electrically driven pump assembly 500 includes a motor 510 that is at least partially positioned external to a drill string 502. In a conventional manner, the motor 510 is coupled to a pump 520 via a shaft assembly 530. A supply flow path 504 conveys supply fluid designated with arrow 505 and a return flow path 506 conveys return fluid designated with arrow 507. As can be seen, the FIG. 6A arrangement does not include leak paths through which the high-pressure supply fluid 505 can invade the return flow path 506. Thus, there is no need for high pressures seals.

In one embodiment, the motor 510 includes a rotor 512, a stator 514, and a rotating seal 516 that protects the coils 512 and stator 514 from drilling fluid and cuttings. In one embodiment, the stator 514 is fixed on the outside of the drill string 502. The coils of the rotor 512 and stator 514 are encapsulated in a material or housing that prevents damage from contact with wellbore fluids. Preferably, the motor 510 interiors are filled with a clean hydraulic fluid. In another embodiment not shown, the rotor is positioned within the flow of the return fluid, thereby eliminating the rotating seal. In such an arrangement, the stator can be protected with a tube filled with clean hydraulic fluid for pressure compensation.

Figure 6B:
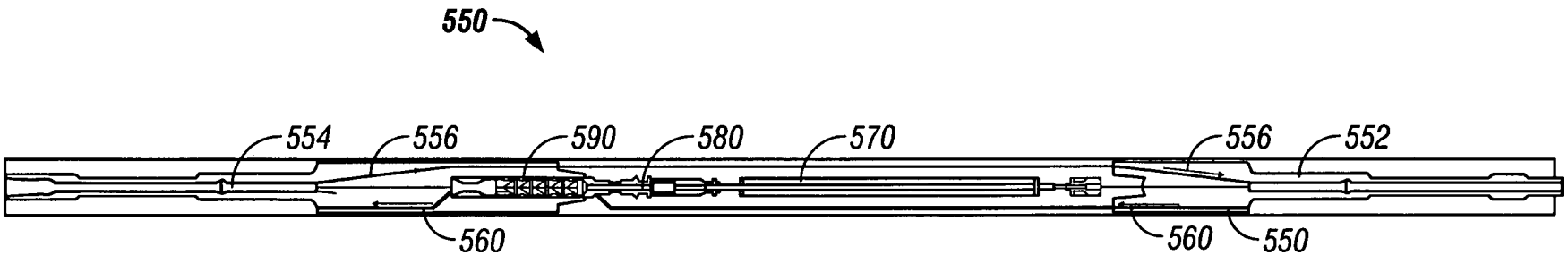
FIG. 6B is a schematic illustration of an embodiment of an arrangement according to the present invention wherein an electric motor disposed within a drill string is coupled to an APD Device.

Referring now to FIG. 6B, there is schematically illustrated one arrangement wherein an electrically driven pump 550 includes a motor 570 that is at least partially formed integral with a drill string 552. In a conventional manner, the motor 570 is coupled to a pump 590 via a shaft assembly 580. A supply flow path 554 conveys supply fluid designated with arrow 556 and a return flow path 558 conveys return fluid designated with arrow 560. As can be seen, the FIG. 6B arrangement does not include leak paths through which the high-pressure supply fluid 556 can invade the return flow path 558. Thus, there is no need for high pressures seals.

It should be appreciated that an electrical drive provides a relatively simple method for controlling the APD Device. For instance, varying the speed of the electrical motor will directly control the speed of the rotor in the APD device, and thus the pressure differential across the APD Device. Further, in either of the FIG. 6A or 6B arrangements, the pump 520 and 590 can be any suitable pump, and is preferably a multi-stage centrifugal-type pump. Moreover, positive displacement type pumps such a screw or gear type or moineau-type pumps may also be adequate for many applications. For example, the pump configuration may be single stage or multi-stage and utilize radial flow, axial flow, or mixed flow. Additionally, as described earlier, a comminution device positioned downhole of the pumps 520 and 590 can be used to reduce the size of particles entrained in the return fluid.

It will be appreciated that many variations to the above-described embodiments are possible. For example, a clutch element can be added to the shaft assembly connecting the drive to the pump to selectively couple and uncouple the drive and pump. Further, in certain applications, it may be advantages to utilize a non-mechanical connection between the drive and the pump. For instance, a magnetic clutch can be used to engage the drive and the pump. In such an arrangement, the supply fluid and drive and the return fluid and pump can remain separated. The speed/torque can be transferred by a magnetic connection that couples the drive and pump elements, which are separated by a tubular element (e.g., drill string). Additionally, while certain elements have been discussed with respect to one or more particular embodiments, it should be understood that the present invention is not limited to any such particular combinations. For example, elements such as shaft assemblies, bypasses, comminution devices and annular seals discussed in the context of positive displacement drives can be readily used with electric drive arrangements. Other embodiments within the scope of the present invention that are not shown include a centrifugal pump that is attached to the drill string. The pump can include a multi-stage impeller and can be driven by a hydraulic power unit, such as a motor. This motor may be operated by the drilling fluid or by any other suitable manner. Still another embodiment not shown includes an APD Device that is fixed to the drill string, which is operated by the drill string rotation. In this embodiment, a number of impellers are attached to the drill string. The rotation of the drill string rotates the impeller that creates a differential pressure across the device.

It should be appreciated that the embodiments of the present invention heretofore described provide enhanced control of wellbore pressures. Methods of controlling these and other embodiments of the present invention can also enhance drilling activities.

One exemplary method of control involves pre-setting one or more operating parameters of an APD Device such that the APD Device causes a selected pressure differential in the return fluid. Exemplary operating parameters include the flow rate of drilling fluid through the APD Device, the rotational speed of the APD Device, and the operating pressure of the APD Device. Suitable devices for exerting control over these operating parameters include bypass valves, speed governers, pressure regulators, relief valves, etc. These devices can be positioned to control operation of the motor and/or the pump. Of course, other factors such as drilling fluid properties and operating pressure and flow rates of the drilling fluid will also have to be considered with setting the operating parameter(s).

Referring back to FIGS. 1A, 4A–D, in one exemplary previously described arrangement, the motor bypass 310 selectively channels conveys fluid around the motor 200. The motor bypass 310 includes a valve 312 and a passage 314 formed through the motor rotor 202 and allows a selected amount of drilling fluid to bypass the positive displacement motor, which directly controls the speed of the motor and the pump. Because the speed of the motor 200 and the pump and the output pressure differential of the pump 220 are directly related, appropriate selection of the flow rate into the valve 312 and line 314 can provide control over the pressure differential caused by the pump 220. In one arrangement, a formation pressure parameter such as the pore pressure, the collapse pressure, and/or the fracture pressure are determined using known formation evaluation tools (e.g., formation fluid pressure testers, pressure subs, leak off testers, etc.). These formation pressure parameters can be determined at a casing shoe 151 (FIG. 1), at a location proximate to the wellbore bottom and/or any intermediate location. Next, the operating parameter (e.g., flow rate) is selected such that the pump output pressure differential effects a desired condition in the well (e.g., an over-balance, an at-balance, an underbalance) at a selected location in the well (e.g., at wellbore bottom, at the casing shoe, or a intermediate location). Thereafter, the APD device 170 is positioned in the wellbore and operated. Under a set operating condition (e.g., surface determined drilling fluid weight, pressure and flow rate), the APD Device 170 will produce a substantially constant pressure differential in the return fluid.

Figure 7:
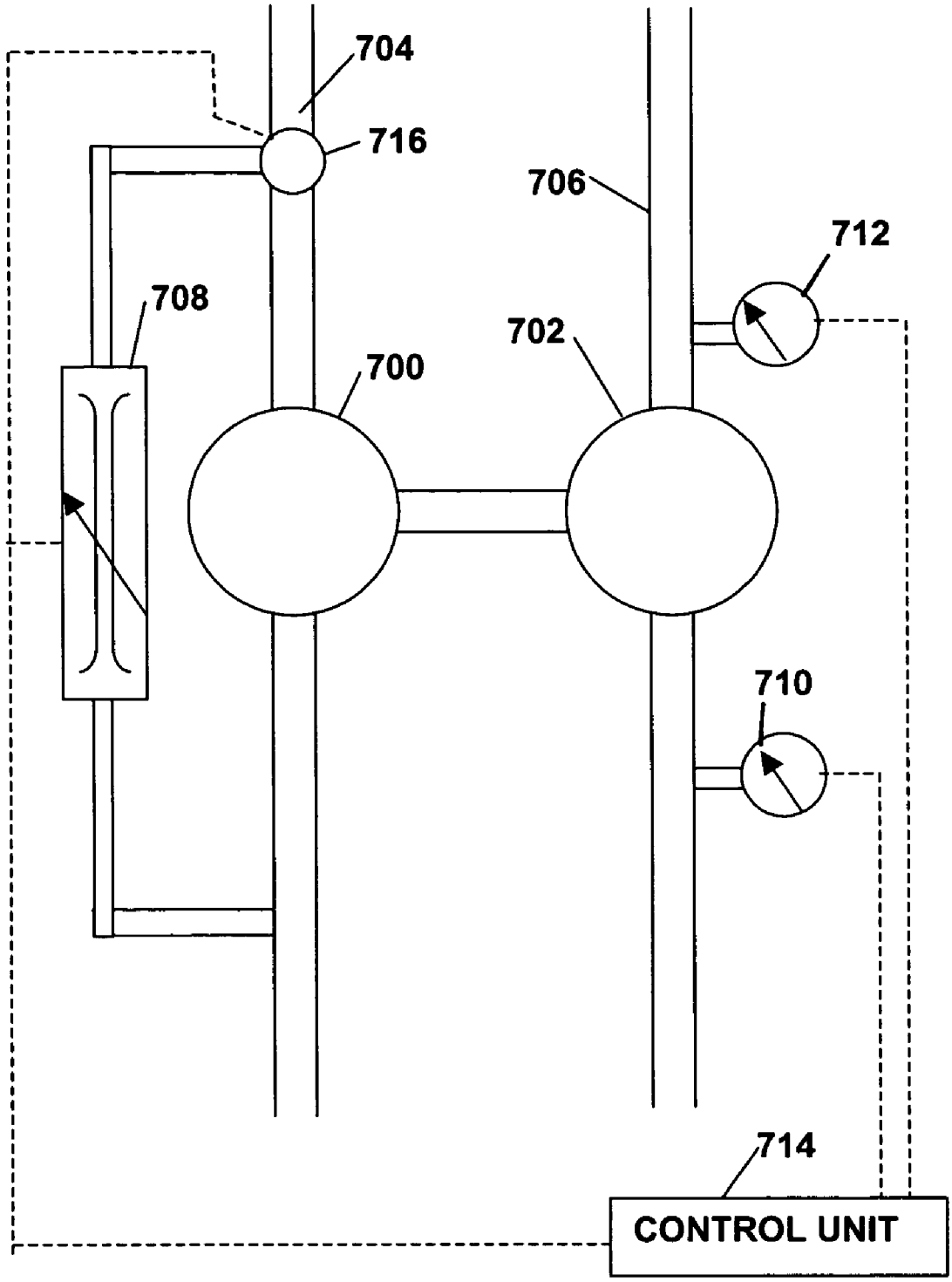
FIG. 7 schematically illustrates one embodiment of a control system for controlling an active pressure differential device in accordance with the present invention.

Referring now to FIG. 7, there is shown one exemplary method for providing active control over the APD Device. This can be advantageous when the pressure in the wellbore annulus is not constant. Common activities and occurrences that can lead to transient pressure behavior in the wellbore include start up and shut down of the pumps, swab and surge effects while tripping, variable cutting load, temperature, tool performance change, variable flow rate change, and heave. Furthermore the desired pressure reduction might change during drilling operation. Thus, active control (e.g., adjustment, modulation, etc.) may be desirable to efficiently management wellbore pressure during such dynamic events and during normal drilling operations.

In FIG. 7, there is schematically shown a motor 700 coupled to an APD Device such as a pump 702. The motor 700 is energized by pressurized drilling fluid flowing in a tubing 704 and the pump 702 is positioned in the return fluid flowing through the annulus 706. An adjustable bypass 708 runs parallel to the motor 700 and includes a flow control assembly such as a nozzle that is manipulated by an actuator responsive to control signals. The adjustable bypass 708 diverts a selected amount of drilling fluid from uphole of the motor 700 and conveys it to a location downhole of the motor 700. In other arrangements, the adjustable bypass 708 can divert the fluid to the annulus 706. In other arrangements the bypass can be positioned on the pump side to selectively divert fluid around the pump 702. On the return side, a first pressure sensor 710 is positioned uphole (e.g., at an inlet) of the pump 702, and a second pressure sensor 712 is positioned uphole (e.g., at an outlet) of the pump 702. The control unit 714 receives pressure measurement data from the first and second sensors 710,712 and is operatively coupled to the adjustable bypass line 708. It can also receive flow rate data from one or more flow rate sensors 716 in the supply line 704. The control unit 714 can have a memory module programmed with instructions and algorithms for computing a control signal for the adjustable bypass.

In one mode of operation, the control unit 714 is programmed with an operating norm for the pressure differential provided by the pump 702 during operation. This norm can be a selected value for pressure differential, a minimum pressure differential, a maximum pressure differential, and/or a range of pressure differentials. Thus, if the pressure measurements from the first and second pressure sensors 710,712 indicate an out-of-norm operating condition, the control unit 714 issues appropriate control signals to adjustable bypass 708 to return the operating condition to established norms. The signals can, for example, cause an increase in the flow rate through the adjustable bypass 708 to reduce motor speed and thereby reduce the pressure differential caused by the pump 702. In embodiments where the bypass 708 is positioned on the return side, the flow rate across the pump 702 can be increased or decreased as needed to control the pressure differential. The control unit 714 can also be programmed with instructions for handling transient conditions such as a gas kick or other condition that can destabilize the wellbore environment. In some embodiments, the control unit 714 can have a dynamically updatable memory that utilizes well specific data (e.g., formation evaluation data) to optimize control of the motor 700 and pump 702.

Figure 8:
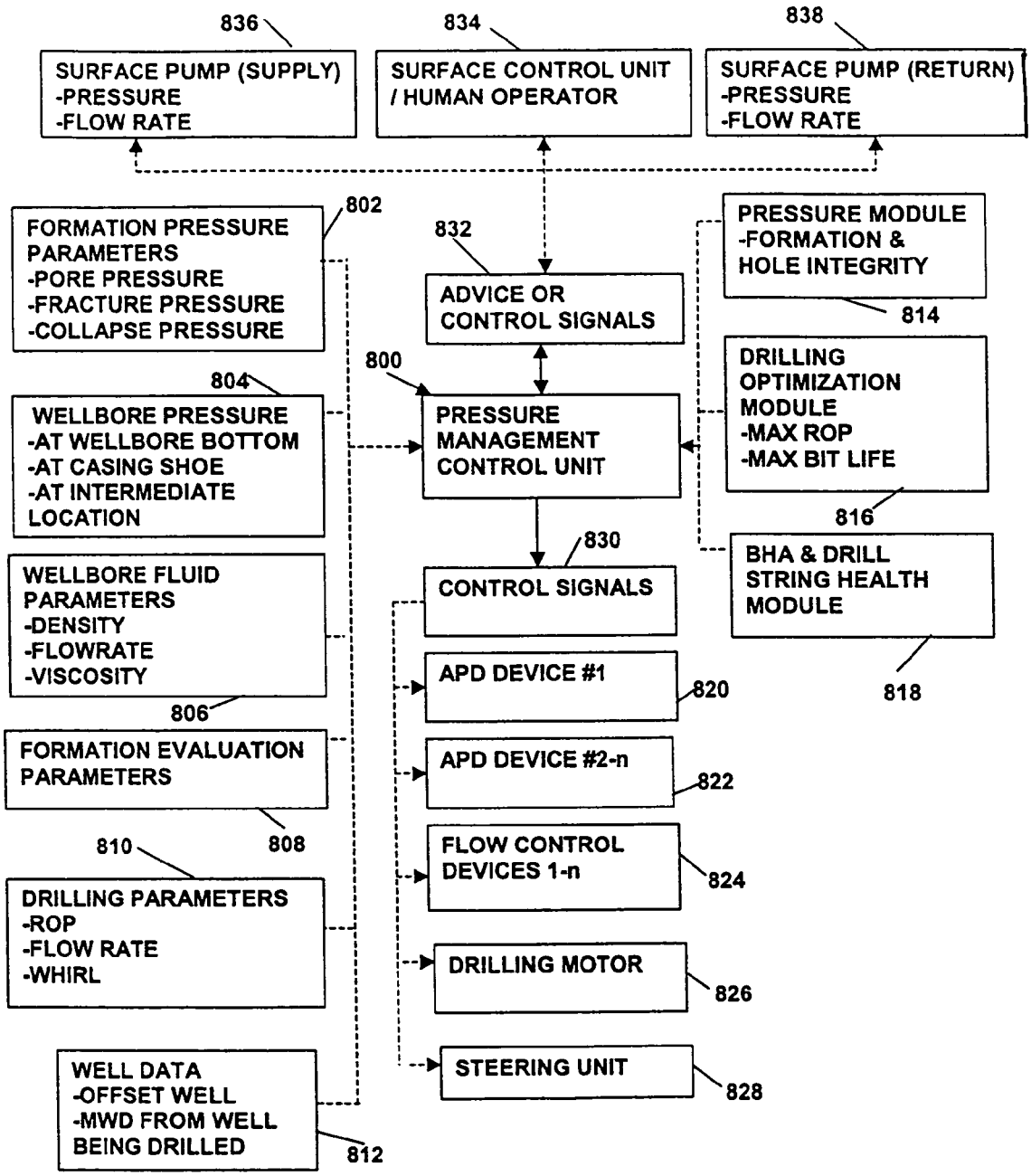
FIG. 8 is a flow chart illustrating an control system in accordance with one embodiment of the present invention.

Referring now to FIG. 8, there is schematically illustrate one embodiment of a pressure control system that may be employed with one or more of the previously described wellbore pressure control systems. The system includes a downhole control unit 800 adapted to at least manage pressure in the wellbore. The control unit 800 utilizes pre-programmed data as well as data measured during drilling including: formation pressure parameters 802 such as pore pressure, collapse pressure and fracture pressure that have been previously measured or are measured during drilling; wellbore pressure 804 measured at selected locations such as the casing shoe or wellbore bottom; wellbore fluid parameters 806 such as density, flow rate, viscosity, etc.; formation evaluation parameters 808 such as resistivity, porosity, gamma ray, nuclear, etc.; and drilling parameters 810 such as ROP and flow rates. Formation evaluation data 812 either from an offset well or MWD data from the drilled well can also be made available to the control unit 800. The control unit 800 can also include processing modules having programmed instructions. These instructions can be used to make determinations as to the appropriate adjustments that must be made to maintain a current operating condition, create a different operating condition, alleviate a safety concern or dysfunction, and/or optimize drilling. Exemplary processing modules include a pressure control module 814 for maintaining wellbore pressures such that the formation is not damaged or does not cause an unsafe wellbore condition, a drilling optimizing module 816 for maintaining drilling at optimal ROP or extended life, and a module 818 for maintaining the health of the drill string and BHA.

The control unit 800 can be configured to control one or more downhole tools including one or more APD Devices 818,820, one or more flow control devices 822, and BHA devices such as the drilling motor 824, and 826. It should be understood that these described devices are merely illustrative of the devices can be controlled by the control unit 800. In one mode of operation, the control unit 800 operates in a closed loop fashion. For example, the control unit 800 periodically receives wellbore pressure data from one or more pressure sensors. This pressure data or extrapolation/interpolations of the pressure data can be used to determine the pressure at selected locations in the wellbore. The control unit 800 can utilize the modules 814,816,818 to determine whether the pressure data requires adjustment of downhole operating conditions and, if so, the values to be used to make the necessary adjustments. The values are converted to control signals 830 that are transmitted to one or more downhole devices 820–828. In another mode of operation, the control unit 800 transmits data to a surface controller 832 which may be human and/or a computer. The data can be digitized and pre-processed data as well as recommended actions (advice). The surface controller 832 can take appropriate measures such as adjusting the operating set points of surface pumps or other steps (e.g., altering WOB, altering rotation speed, etc.). In such a mode, the control unit 800 can be adapted to receive and execute command signals from the surface.

Figures 9A, 9B:
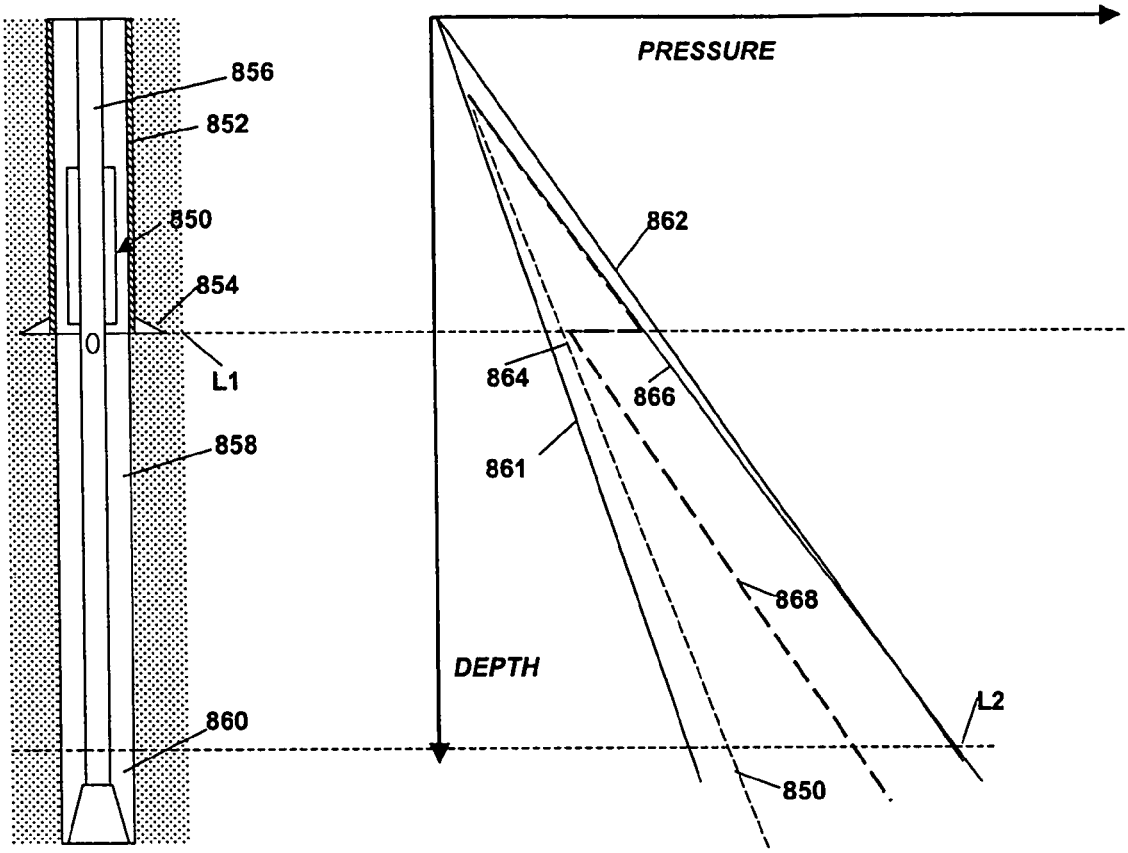
FIGS. 9A & B schematically illustrate a wellbore pressure profile provided by a control system made in accordance with one embodiment of the present invention.

Referring now to FIGS. 9A and 9B there is shown one arrangement for controlling a system for controlling wellbore pressure. FIG. 9A illustrates an elevation view of an APD Device 850 positioned in a casing 852 proximate to a casing shoe 854. A drill string 856 extends downward into an open hole 858 below the casing 852 and terminates at a wellbore bottom 860. In one pressure management arrangement, a pore pressure is determined for the open hole adjacent the casing shoe 854. As is known, the pore pressure represents the pressure of the fluid in the formation. A wellbore pressure higher than the pore pressure is generally desirable because such a wellbore pressure will prevent the formation fluids from flowing into the wellbore. Also, drilling fluid can be circulated (without drilling the formation) so that the wellbore pressure at the casing shoe 854 can be determined using a tool such as a pressure sub. FIG. 9B illustrates an exemplary pressure gradient for the FIG. 9A embodiment. Line 861 represents the pore pressure of the formation, line 862 represents the fracture pressure of the formation, line 864 represents the collapse pressure of the formation, and line 866 represents the total pressure or ECD of the drilling fluid. As shown, at depth L2, the ECD pressure line would exceed the fracture pressure—which as discussed previously represents a barrier to further drilling. Thus, it is advantageous to shift line 866 to the left (i.e., reduce its magnitude) in order to continue drilling, the shifted line shown as a dashed line 868. It should be noted, however, that shifting line 868 too far to the left would cause the ECD to drop below the pore pressure at the casing shoe at depth L1. That is, attempting to provide a maximum pressure reduction at the wellbore bottom, while theoretically increasing the drilling depth, can cause an undesirable under-balance in uphole regions, and in particular, proximate to the casing shoe. Thus, in one arrangement, the pressure differential caused by the APD Device 850 should be selected with reference to the pore pressure at the casing shoe. For example, the pressure differential may be selected such that a safety margin in an overbalance condition is always maintained. In other arrangements, it may be acceptable to select a pressure differential that causes an at-balance or under-balance condition at the casing shoe. In many situations, it may be desirable to utilize the pore pressure at the casing shoe as limit on the pressure differential that can be provided at the wellbore bottom. In any of these control scenarios, the pressure of the wellbore at the casing shoe is either directly or indirectly measured to control whatever condition is selected at the casing shoe 854.

It should be understood that the term pressure as it relates to wellbore fluids (e.g., drilling fluids) is used interchangeably with the term equivalent circulating density (ECD) or equivalent static density (ESD). In the above, the term "casing shoe" is used as a reference to the casing shoe proximate to the open hole section of a wellbore.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method of controlling pressure in a wellbore drilled in a formation using a drill string having a bottomhole assembly at an end of a tubing and wherein a drilling fluid supplied under pressure to the tubing returns to the surface ("the return fluid"), the method comprising:

(a) providing an Active Pressure Differential Device ("APD Device) in the return fluid; and (b) controlling the APD Device to control a pressure relative to a formation pressure parameter at a selected location in the wellbore.

2. The method of claim 1, further comprising controlling the APD Device in response to at least one determined parameter relating to a selected fluid in the wellbore.

3. The method according to claim 2 wherein the selected fluid is drilling fluid and the at least one determined parameter is selected from one of (i) flow rate, (ii) density, (iii) temperature, and (iv) pressure.

4. The method of claim 1, further comprising controlling the APD Device in response to a determined pressure differential between an inlet of the APD Device and an outlet of the APD Device using a control unit.

5. The method of claim 4, wherein the APD Device is controlled to provide a pre-determined pressure differential between the APD Device inlet and outlet.

6. The method according to claim 1 further comprising determining at least one formation parameter, and wherein the APD device is further controlled in response to the at least one formation parameter.

7. The method according to claim 6 wherein the formation parameter is selected from one of (i) pore pressure, (ii) fracture pressure, (iii) a geophysical property, (iv) a petrophysical property, and (v) collapse pressure.

8. The method according to claim 1 further comprising determining at least one drilling parameter, and wherein the APD device is further controlled in response to the at least one drilling parameter.

9. The method according to claim 8 wherein the drilling parameter is selected from one of (i) ROP, (ii) vibration, and (iii) flow rate.

10. The method of claim 1, wherein the selected location in the wellbore at which the pressure is controlled is one of (i) at the wellbore bottom, (ii) proximate to a casing shoe, (iii) at an open wellbore section uphole of the bottomhole assembly; and (iv) in a casing.

11. The method of claim 1 further comprising: controlling the APD Device in response to the determined pressure differential between the formation pressure parameter and a pressure of the drilling fluid.

12. The method of claim 1, wherein the formation pressure parameter is selected from one of (i) pore pressure, (ii) collapse pressure, and (iii) fracture pressure.

13. The method of claim 1 further comprising: providing at least a second APD Device in the return fluid; and controlling the APD Device and the second APD Device to provide a selected pressure profile in the wellbore.

14. A method of controlling pressure in a wellbore drilled in a formation using a drill string having a bottomhole assembly at an end of a tubing and wherein a drilling fluid supplied under pressure to the tubing returns to the surface ("the return fluid"), the method comprising:

(a) providing an Active Pressure Differential Device ("APD Device") for controlling pressure in the wellbore, the APD Device having at least one operating parameter settable to control a pressure differential provided by the APD Device;

(b) setting the at least one operating parameter for the APD Device such that the APD Device will cause a selected pressure differential in the return fluid;

(c) positioning the APD Device in the return fluid in the wellbore; and (d) operating the APD Device to provide the selected pressure differential in the return fluid.

15. The method according to claim (14) wherein the operating parameter is selected from one of (i) flow rate, (ii) speed, and (iii) pressure.

16. The method according to claim (14) further comprising determining a formation pressure parameter relating to the formation at a casing shoe in the wellbore, and wherein the operating parameter is selected to provide a specified pressure differential with respect to the determined formation pressure parameter.

17. The method according to claim (16) wherein the formation pressure parameter is selected from one of (i) pore pressure, (ii) collapse pressure, and (iii) fracture pressure.

18. The method according to claim (16) further comprising positioning the APD Device in a casing in the wellbore.

19. The method according to claim (14) wherein the operating parameter is set at the surface.

20. The method according to claim (14) further comprising determining a pressure differential between an inlet of the APD Device and an outlet of the APD Device; and setting the operating parameter of the APD Device in response to the determined pressure differential.

21. The method according to claim (14) further comprising determining a pore pressure proximate to a casing shoe and setting the operating parameter to provide a wellbore pressure at the casing shoe that provides a condition selected from one of (i) an over-balance, (ii) an at-balance, and (iii) and an under-balance.

22. The method according to claim (14) wherein the at least one operating parameter can be set by adjusting an adjustable fluid bypass that diverts fluid around one of (i) the APD Device; and (ii) a motor associated with the APD Device.

23. The method according to claim (14) further comprising controlling the APD Device with a control unit adapted to adjust the operating parameter of the APD Device in response to at least one determined parameter.

* * * * *